US006528712B2

(12) United States Patent
Lehoux

(10) Patent No.: US 6,528,712 B2
(45) Date of Patent: Mar. 4, 2003

(54) UPPER PIVOT SUPPORT FOR A GUITAR

(76) Inventor: Randy A. Lehoux, 183 A Jagger Mill Rd., Sanford, ME (US) 14073

( * ) Notice: Subject to any disclaimer, the term of this patent is extended or adjusted under 35 U.S.C. 154(b) by 0 days.

(21) Appl. No.: 09/907,390

(22) Filed: Jul. 17, 2001

(65) Prior Publication Data

US 2003/0015081 A1 Jan. 23, 2003

(51) Int. Cl.[7] ..... G10D 3/00
(52) U.S. Cl. ..... 84/327; 84/329
(58) Field of Search ..... 84/327, 329; 2/2, 2/464, 338, 311, 312, 315; 224/901.4, 901

(56) References Cited

U.S. PATENT DOCUMENTS 3,102,446 A * 9/1963 Raleigh ..... 84/327
3,955,461 A * 5/1976 Ivie ..... 84/327
6,031,167 A * 2/2000 Gaston ..... 84/327
6,189,158 B1 * 2/2001 Lehoux ..... 2/455
6,259,007 B1 * 7/2001 Stuart ..... 84/281
6,359,203 B1 * 3/2002 Cronos ..... 84/280

* cited by examiner

*Primary Examiner*—Kim Lockett
(74) *Attorney, Agent, or Firm*—William F. Hamrock, PA

(57) ABSTRACT

An upper pivot support for a guitar which is supported by a support system which holds the guitar in the front of the player's body with the strumming end of the guitar hanging downwardly. The pivot support encompasses an outwardly extending enclosed cushioned pivot secured to an upper front portion of an enclosed rigid backboard which is releasably mountable within the waistband on the player. The enclosed cushioned pivot extending outwardly places the guitar further away from the rib cage area providing a clearer view of the strumming end in a more comfortable and less tense position.

6 Claims, 2 Drawing Sheets

UPPER PIVOT SUPPORT FOR A GUITAR

BACKGROUND OF THE INVENTION

The present invention relates to an upper pivot support for supporting and positioning a guitar or similar instrument, hereinafter referred to as a guitar, which is supported by a waist band and a shoulder strap or other system that allows the guitars strumming end to hang in the vicinity of the player's waistband, and to act as a pivot point to rotate the guitar to a more comfortable and less tense position in the chest area of the player.

The weight of a guitar is heavy and uncomfortable to hold for long periods of time. Various suspension systems for supporting the guitar in the front of the body have been used. Types of suspension strap systems commonly used are shoulder strap systems, waistband systems and other systems wherein the strumming end of the guitar hangs loosely at the hip area or higher up above in the waistband area of the player. The difficulties with these positionings of the guitar are that the loosely hanging weight at the strumming end of the instrument requires the player to support it with various parts of the upper body and also the player is required to be continuously maneuvering the guitar into a better position to view the guitar and into a better playing angle. Within a period of time, the player develops fatigue and discomfort caused to some extent by these positionings of the guitar. With respect to the strumming end loosely hanging at the hip area of the player, applicant has recently developed a Rest Support for a Guitar, U.S. Pat. No. 6,189,158, patent date Feb. 20, 2001 which overcomes the deficiencies of supporting a guitar hanging down in the hip area. The present invention is directed to improving the efficiencies of all guitar support systems where the strumming end of the guitar hangs loosely higher up above the waistband of the player.

SUMMARY OF THE INVENTION

The present invention overcomes the deficiencies of prior support systems wherein the strumming end of the guitar hangs loosely at or above the player's waistband by helping to support and pivot the guitar in the front chest area of the body. This is accomplished with the present uniquely positioned upper pivot support releasably mounted within the waistband adjacent to the strumming end of the guitar.

The present guitar upper pivot support provides a resilient, flexible cushioning material enclosed support secured to the upper front of a rigid or semi-rigid backboard mounted within the front of the waistband. The enclosed support extends outwardly from the front of the player's rib area forming a wedge pivot point for supporting the weight and movement of the strumming end of the guitar. The rigidity of the enclosed backboard securely holds the outwardly enclosed cushioned support in position to firmly support pivoting of the guitar outwardly while positioning the instrument in a more comfortable and less tense position to more clearly view the strumming and fret ends of the guitar. By combining the upper pivot support of the invention with the various suspension systems for supporting guitars on the upper front area of the player above the waistband, there is a more uniform distribution of the weight in a more comfortable position with a better view of the instrument than previously obtainable.

BRIEF DESCRIPTION OF THE INVENTION

DETAILED DESCRIPTION OF THE PREFERRED EMBODIMENT

Figure 1:
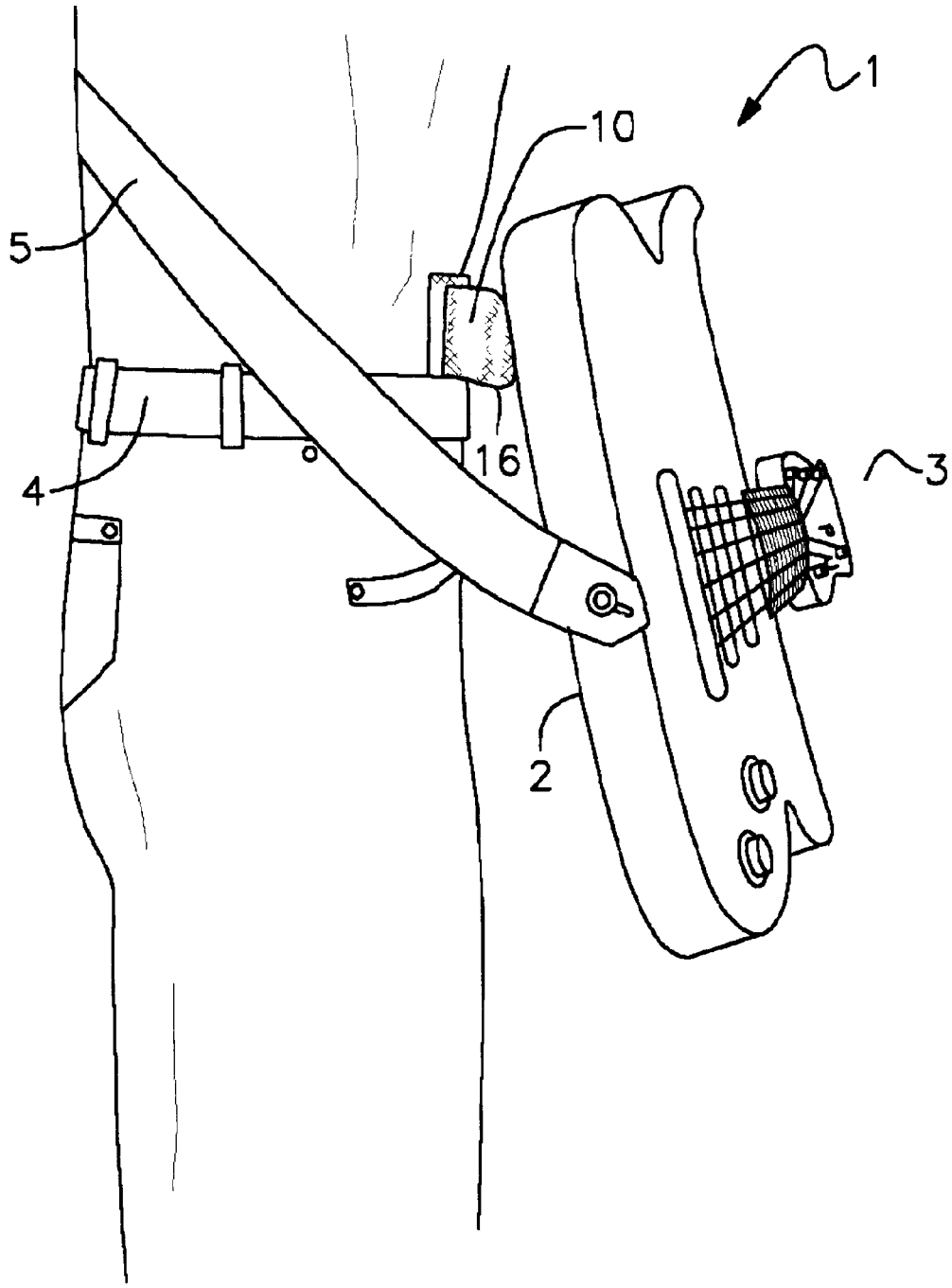
FIG. 1 is a side view of a player wearing an upper pivot support of the invention as a pivot point for a guitar.

Shown in FIG. 1 is an illustration of a player having an upper pivot support 10 of the invention helping to pivot a guitar 1 in the chest area of the player's body. Illustrated are the lower hanging strumming end 2 and the upper fret end 3 located at opposite ends of the guitar, a waistband 4 and an example of a shoulder strap harness 5 of a support system mounting a guitar on a player. The present upper pivot support is applicable with any support system which provides for the strumming end of the guitar to be actively positioned and manipulated above the waistband in the chest area of the player.

Figure 2:
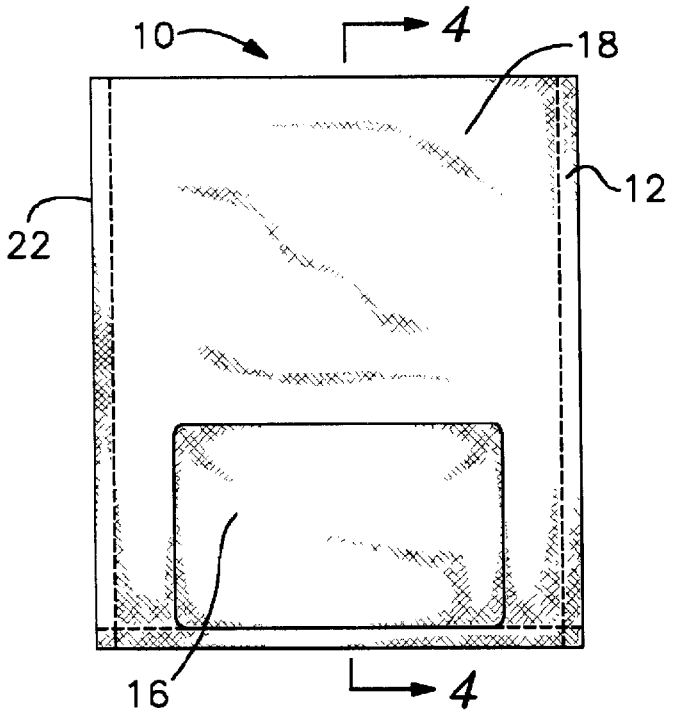
FIG. 2 is a detailed upside down veiw of the upper pivot support of the invention.
Figure 3:
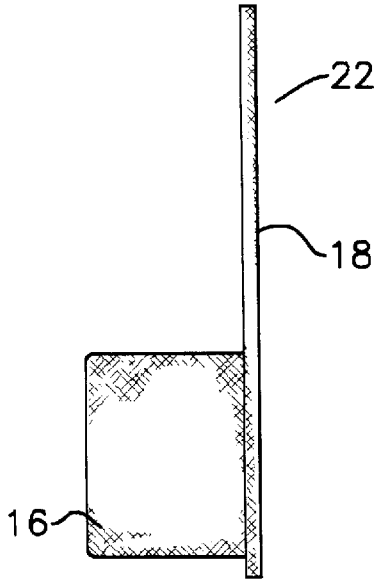
FIG. 3 is a side view illustrating the upper pivot support.
Figure 4:
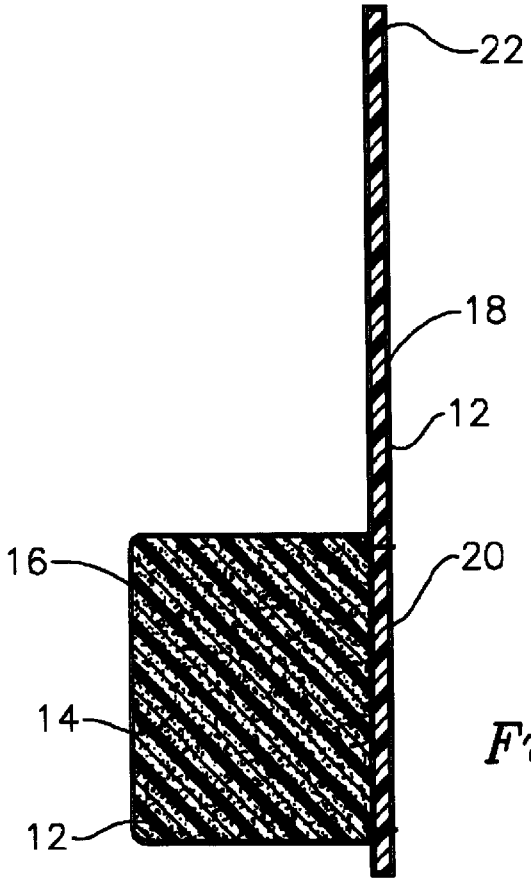
FIG. 4 is a cross section view illustrating the upper pivot support.

FIG. 2 illustrates a front isolated inverted veiw of a preferred embodiment of the upper support 10 of the invention. The upper pivot support depicted is the embodiment shown in FIG. 1 is releasably mounted in the player's waistband 4 extending upwardly above the waistband. The inverted upper pivot support 10 as shown in the inverted FIGS. 2, 3 and 4 provides a covering 12 which can be friction surfaced enhanced such as frictionized fabric or frictionized rubber or elastomeric or plastic covering. One section of the covering completely encases a resilent enclosed foam material 14 forming a rectangular shaped covered cushion pivot 16 mounted on a flat stiff support 18. The enclosed foam material 14 can be anytype of substance such as plastic or elastomeric cushioning material, an air filled cushion or combination of materials or any material that provides a cushioned support. Covered cushion pivot 16 is generally about four inches in length and about two inches in thickness but other dimensions are applicable which provide optimum cushioning and pivoting support characteristics required for operating the guitar in the chest area of the player. The major portion of covering 12 completely encases a rigid or semi rigid rectangular backboard prepared from rigid or semi-rigid plastic, rubber, foam or other similar interfacing material. The enclosed rectangular backboard is generally about six to ten inches wide and about six to twelve inches in length but other dimensions are applicable as required to support the guitar appropriately. The upper pivot support 10 is formed by securing the covered cushion pivot 16 mounted on flat support 18 to the upper portion of the covered blackboard 20 by means of sewing or other securing means depicted in FIG. 1.

In use, the covered upper pivot support 10 is adjustably mounted as shown in FIG. 1 by sliding the flat sturdy lover section 22 into the waistband 4 of the pants with the upper cushion pivot 16 positioned above the waistband as shown in FIG. 1. When many players positon the guitar up in their chest cavity, with the guitar being held in such a high position, most of the weight is transferred to the players's alms. The present invention helps to alleviate to some extent the fatigue and discomfort associated with the chest positioning of the guitar. When the upper pivot support 10 is adjustably located strategically above the waistband and behind the strumming the guitar covered cushion pivot 16 is positioned to function as a pivot point. This pivot point positioning provides a means by which the player can rotate the guitar at will while playing by pressing down on the strumming end with the strumming arm. The outwardly extending covered cushion pivot 16 secured to the stiff flat backboard 18 forces the strumming end 2 farther away from the rib cage area while positioning a player's strumming arm further away from the rib cage to a more comfortable and less tense position. The thickness of the covered pivot 16 provides pivoting of the strumming end outwardly to better angles so as to more clearly veiw the strumming end and the fret end of the guitar as depicted in FIG. 1. The rigidity of the flat backboard 18 firmly mounts the pivot support in place within the waistband.

While the present invention has been described and illustrated with respect to the preferred embodiment, it will be appreciated that variations of the invention may be made without departing from the scope of the invention which is defined in the appending claims.

What is claimed is:

1. An upper pivot support in combination with a player's waistband and upper body guitar strap support system for pivoting and positioning a guitar having a strumming end and a fret end in the front of the player standing upright comprising the waistband encompassing the midsection on the player, the shoulder strap support system providing the strumming end to hang downwardly in front of the waistband the upper pivot support comprising an outwardly horizontal extending enclosed rectangular cushioned pivot secured to an upper front portion of an upright vertical enclosed rigid backboard whereby said verticle backboard is releasably mountable downwardly within the waistband and the horizontal extending cushioned pivot extends outwardly above the waistband for pivoting the guitar away from the body.

2. The upper pivot support according to claim 1 wherein enclosed cushioned pivot and enclosed backboard have friction enhanced outer surfaces.

3. The upper pivot support according to claim 1 wherein the enclosed cushioned pivot is a fabric enclosed foam material.

4. The upper pivot support according to claim 1 wherein the enclosed cushioned pivot is secured to a fabric enclosed backboard by sewing.

5. The upper pivot support according to claim 1 wherein the enclosed cushioned pivot is about two inches in thickness.

6. The upper pivot support according to claim 5 wherein the enclosed cushioned pivot forms a rectangular pivot.

* * * * *